US007311199B2

(12) United States Patent
Vantilt

(10) Patent No.: US 7,311,199 B2
(45) Date of Patent: Dec. 25, 2007

(54) BUNDLES OF ROLLS AND METHOD FOR PRODUCTION THEREOF

(75) Inventor: Pierre Vantilt, Tongeren (BE)

(73) Assignee: Knauf Insulation SA, Visé (BE)

( * ) Notice: Subject to any disclaimer, the term of this patent is extended or adjusted under 35 U.S.C. 154(b) by 264 days.

(21) Appl. No.: 10/556,406

(22) PCT Filed: May 18, 2004

(86) PCT No.: PCT/EP2004/050835

§ 371 (c)(1),
(2), (4) Date: Nov. 10, 2005

(87) PCT Pub. No.: WO2004/103821

PCT Pub. Date: Dec. 2, 2004

(65) Prior Publication Data

US 2006/0196799 A1 Sep. 7, 2006

(30) Foreign Application Priority Data

May 22, 2003 (BE) ..... 2003/0297

(51) Int. Cl.
*B65D 71/00* (2006.01)

(52) U.S. Cl. ..... 206/321; 206/83.5; 206/391; 206/442; 53/436; 53/477

(58) Field of Classification Search ..... 206/83.5, 206/321, 391–394, 397, 410, 442, 499, 503, 206/597; 53/399, 436, 447, 449
See application file for complete search history.

(56) References Cited

U.S. PATENT DOCUMENTS

| | | | | |
|---|---|---|---|---|
| 4,444,311 | A * | 4/1984 | Rias | 206/391 |
| 4,535,587 | A | 8/1985 | Rias | |
| 4,886,167 | A * | 12/1989 | Dearwester | 206/83.5 |
| 5,129,211 | A | 7/1992 | Anderson | |
| 5,350,063 | A * | 9/1994 | Berdan, II | 206/321 |
| 6,021,890 | A | 2/2000 | Focke et al. | |
| 2002/0059779 | A1 | 5/2002 | Gamberini | |

FOREIGN PATENT DOCUMENTS

| | | |
|---|---|---|
| EP | 0 220 980 | 5/1987 |
| EP | 0 524 062 | 1/1993 |
| EP | 0 679 579 | 11/1995 |
| FR | 2 658 786 | 8/1991 |

* cited by examiner

*Primary Examiner*—Luan K Bui
(74) *Attorney, Agent, or Firm*—Dykema Gossett PLLC

(57) ABSTRACT

A bundle (8) of rolls made from a strip of insulation of a fibrous material, comprising several rolls, arranged side by side with the axes thereof parallel in several superimposed layers with a wrapping film wrapping each layer in a compressed state in a first direction perpendicular to the axes of the rolls and a sleeve enclosing the superimposed layers in a state with the layers compressed one against the other in a second direction (F3) perpendicular to the axes of the rolls and perpendicular to the first direction and covering the first and second ends of the rolls of the bundle.

17 Claims, 4 Drawing Sheets

BUNDLES OF ROLLS AND METHOD FOR PRODUCTION THEREOF

The present invention relates to a bundle of rolls formed of an insulation strip made of a fibrous product having an initial density, said bundle comprising several aforementioned rolls, each having an axis, a peripheral surface and first and second ends, and being arranged one next to the other with their axes parallel, in a number of superposed rows, a packaging film which covers at least said peripheral surface of each roll of the insulation strip which, when wound up on itself, has a density which is greater than said initial density, and a wrapping film which wraps each row of several rolls, in a compressed state of the rolls against one another in a first direction perpendicular to the axes of the rolls, and which covers at least part of the peripheral surface of the rolls of the row.

These bundles are in particular intended to be stacked and then covered, with a view to being stored and transported on various vehicles. The fibrous product of the rolls may be, for example, glass wool or a mineral wool. These are products with a low density which therefore occupy a large volume in the condition in which they are to be used, and this represents a problem in respect of storage and transport.

Bundles such as this have been known for a long time, and these are described for example in EP-B-0 220 980 and EP-B-0 524 062.

However, these known bundles have the drawback that the rows of rolls have a diabolo shape, since the compression effect is concentrated in the center of the rolls. Once the bundles have been set upright in the vertical position, said bundles therefore require a greater storage surface area. Moreover, when the bundles are stacked, stretch-wrapping of the stacked bundles has to be carried out, and this stretch-wrapping is superposed on the wrapping film which has already been applied to each of the bundles, the strip used for this purpose partially overlapping itself during the stretch-wrapping operation, which involves excessive use of packaging material.

Finally, once the strip of fibrous material has been wound up on itself, the rolls have a density value which is determined as a function of the diameter of the roll and of the quality of the wool which must satisfy certain physical properties once the roll has been unwound. Once the bundle has been produced, given the formation of empty spaces between the rolls when they are arranged in stacked rows, the overall density of the bundle exhibits an appreciable loss with respect to the density of the product which had been acquired as the roll was wound up. In order to obtain a bundle with a standard volume for transport and storage, no adjustment can be made with regard to the parameter represented by the diameter of the rolls, since this must be a fixed parameter.

Also known are bundles of cylindrical wound articles which are bundled in this form. The density of the material on which these articles are based, such as paper, fabric, etc, cannot be modified during the formation of the bundles, and the cylindrical shape of the articles is maintained throughout the process (cf., for example, U.S. Pat. No. 5,129,211 and U.S. Pat. No. 6,021,890).

The object of the present invention is to overcome the problems mentioned above and to develop a bundle of rolls formed of an insulation strip made of a fibrous product, which is mechanically resistant and has stable and standardized dimensions, and a simple and inexpensive production method which makes it possible to produce such bundles.

To this end, the invention provides a bundle of rolls as mentioned in the introduction, which furthermore comprises a sleeve which encloses the wrapped and superposed rows of rolls, in a compressed state of the rows against one another in a second direction perpendicular to the axes of the rolls and perpendicular to said first direction, and which covers the first and second ends of the rolls of the bundle and at least part of the peripheral surface of the rolls of a top row and of a bottom row of said superposed rows of the bundle, the bundle thus formed having a final density which is at least equal to 90%, preferably 95%, of said density which is greater than the initial density.

The very particular advantage of this bundle is that the rolls are wrapped not just around their periphery but also over their entire length, so that their ends are kept compressed by the sleeve and so that the rolls do not take on a diabolo shape which requires a greater pallet surface area and therefore a greater storage and transport surface area. The rolls become more resistant in the length direction, and the packaging is better and more uniform the more the wrapping films and the sleeve cross over one another.

The two successive compressions in two perpendicular directions have the effect of maintaining, in the bundled product, the density acquired during the winding of the rolls.

By virtue of the two successive compressions, the rolls advantageously acquire a square cross section which is rounded at the corners, and this reduces the spaces between rolls to the strict minimum. The rolls are pressed against one another over almost all of their peripheral surface which is deformed by the compressions.

Whereas, at present, the stacking of the rows of rolls means that the bundle produced loses a large part of its density on account of empty spaces being created between the stacked rolls, the bundle according to the invention which is compressed in two mutually perpendicular directions and kept in this compressed state recovers this loss of density. The bundles obtained are of a standard volume, substantially independently of the diameters of the rolls and therefore of the length of strip which is wound up.

According to one advantageous embodiment of the invention, the sleeve extends over all of the first and second ends of all of the rolls of the bundle.

In this way, when the bundle is set upright so that the rolls are arranged vertically in order to stack several bundles, the rolls cannot be in contact with a substrate, in particular a floor, or with the external atmosphere on their top side. They therefore do not run the risk of the wool being damaged as a result of contact with dirt or moisture.

According to one improved embodiment of the invention, the packaging film, the wrapping film and/or the sleeve are made of a non-extensible plastics material. The compression of the rows of rolls and of the bundle can thus be obtained and maintained by a single wrapping film and respectively a single sleeve. Use will preferably be made of a high density polyethylene, for example.

The present invention relates not only to a bundle of rolls according to the invention but also to a stack of such bundles, usually two but sometimes more.

The present invention also relates to a method for producing such a bundle or stack of bundles.

To this end, the invention provides a method for producing bundles of rolls according to the invention, which comprises a winding-up of an insulation strip made of a fibrous product, having an initial density, so as to form rolls having then a density which is greater than said initial density, a first wrapping of each roll with a packaging film which covers at least their aforementioned peripheral surface, the arrangement of several aforementioned rolls one next to the other with their axes parallel to form rows, a first compression one against the other of the rolls of each row in a first direction perpendicular to the axes of the rolls, a second wrapping with a wrapping film of each row of several rolls, in a compressed state resulting from the first compression, so as to cover at least part of the peripheral surface of the rolls of the row, a superposition of several rows of rolls thus wrapped, and a second compression one against the other of wrapped and superposed rows of rolls in a second direction perpendicular to the axes of the rolls and perpendicular to said first direction, said method furthermore comprising a third wrapping with a sleeve of the wrapped and superposed rows of rolls, in a compressed state resulting from the second compression, so as to cover the two ends of the rolls of the bundle and at least part of the peripheral surface of the rolls of a top row and of a bottom row of said superposed rows of the bundle, the bundle thus formed having a final density which is at least equal to 90%, preferably 95%, of said density which is greater than the initial density.

Other embodiments of bundles and stacks of bundles according to the invention, along with other embodiments of the method according to the invention, are given in the appended claims.

Other details and features of the invention will emerge from the description which is given below by way of non-limiting example and with reference to the appended drawings.

In the various drawings, identical or similar elements bear the same references.

Figure 1:
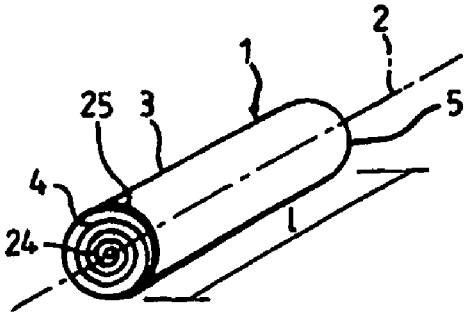
FIGS. 1 to 4 show a perspective view of the steps of a method for forming a bundle according to the invention, up to the stacking of the rows of rolls.

FIG. 1 schematically shows a known roll 1 formed of an insulation strip (24) made of a compressible fibrous product, such as glass wool or mineral wool. This roll has an axis 2, a peripheral surface 3 and two end surfaces 4 and 5. During winding of the roll, the fibrous material has undergone a compression which is determined as a function of the physical properties that the wool must have in the unwound state. Its peripheral surface 3 has then been wrapped in a manner known per se with a packaging film (25). The roll which is formed thus has a given first density and a given diameter d of the end surface. In the example shown, the aforementioned diameter d may for example vary from 380 to 500 mm and the rolls may have a width l of, for example, 1200 mm. This width may of course vary as a function of requirements.

Figure 2:
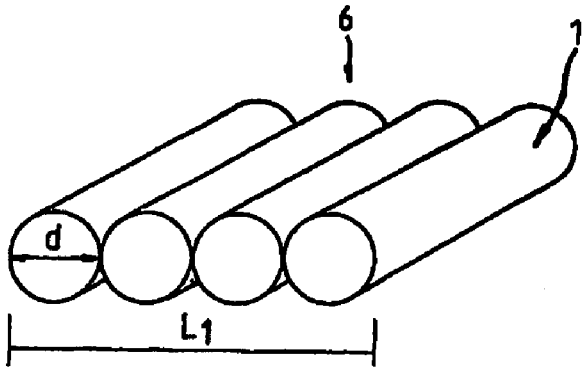

The rolls 1 thus formed are arranged one next to the other with their axes parallel so as to form a row of rolls 6 (cf. FIG. 2). In the example shown, the length L1 of the row is for example 1400 to 2000 mm. It will of course be understood that, depending on the diameter of the end surfaces 4 and 5 of the rolls 1, any suitable number of rolls may be arranged in rows, preferably three or four, as shown.

Figure 3:
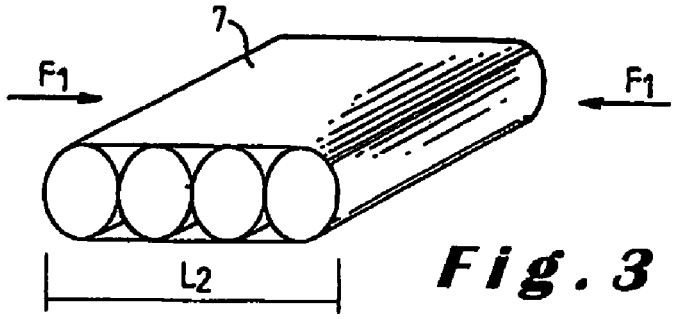

As shown in FIG. 3, this row 6 of rolls 1 is wrapped in a wrapping film 7 after the rolls have been compressed one against the other in a direction shown by the arrows F1, which is perpendicular to the axes 2 of the rolls. Following a compression force of around 1.5 tons for example, the rolls have an oval cross section and the length L2 of the compressed row becomes, in the example shown, 1330 mm. The wrapping film 7 is preferably formed of a strip made of non-extensible plastics material, for example high density polyethylene, so that the wrapping film keeps the rolls of the row 6 in their compressed state. Very advantageously, the film 7 extends from one end to the other of the rolls on part of their peripheral surface 3, leaving the end surfaces 4 and 5 of the rolls free.

Figure 4:
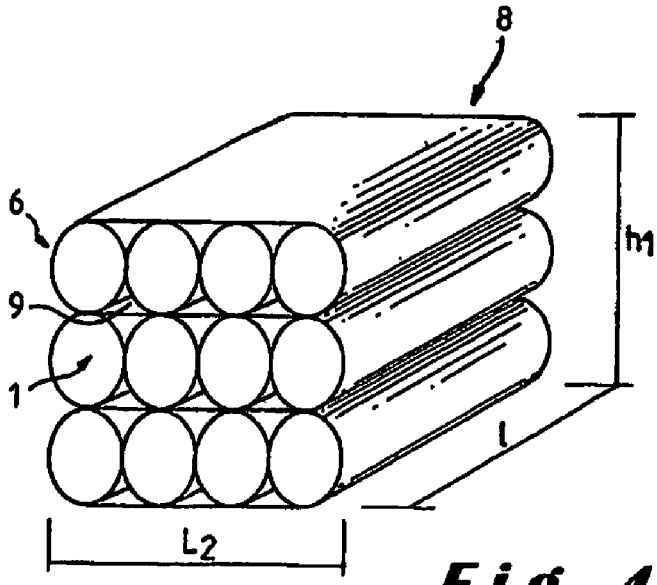

In a bundle according to the invention, several rows of rolls as shown in FIG. 3 are then stacked as shown in FIG. 4. It is possible to provide for stacking of any suitable number of compressed and wrapped rows of rolls 6, for example three rows as shown. Twelve rolls are thus obtained in the illustrated bundle 8, and for example nine rolls if each row comprises only three rolls. In the state shown in FIG. 4, the bundle has, in the example illustrated, a width l of 1200 mm, a length L2 of 1330 mm and a height h1 of 1600 mm.

All the production steps up to the formation of the bundle shown in FIG. 4 are known in a very general manner in the prior art. By way of example, reference may be made more particularly to EP-B-0 220 980. It would of course also be possible to envisage other ways of forming such a bundle, for example by pushing the stacked and compressed rows into the opening of a preformed sheath.

It must be noted at this stage that, on account of the presence of empty spaces 9 between the rolls and the rows of rolls in the bundle, the latter exhibits a loss of density of 30% and sometimes more compared to the density of a roll which has just been wound up.

It must also be noted that, in the bundles according to the prior art in which vertical compression does not take place, the diameter of the rolls must always be fixed at the start if it is desired to obtain a bundle which always has approximately the same volume. This represents a disadvantageous restriction when the various requirements of the users must be met, for example in terms of the length of strip in each roll.

Figure 6:
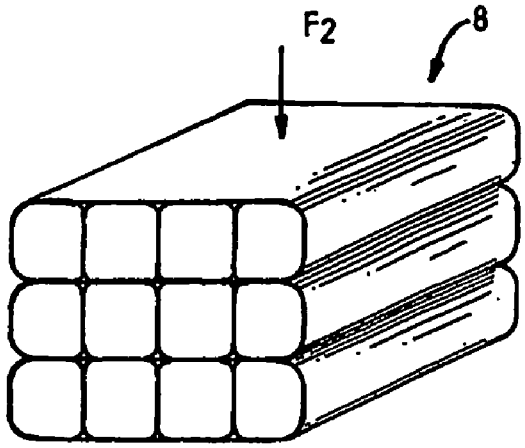
FIG. 6 shows a perspective view of the stack of rows of rolls in the compressed state.

As shown in FIG. 6, the bundle according to the invention comprises rows of rolls which are stacked in a compressed state of the rolls one against the other in a direction shown by the arrow F2. A compression force of around 2 tons may thus be applied. The direction F2 is not only perpendicular to the axis 2 of the rolls 1 but also to the direction of the first compression shown by the arrows F1 in FIG. 3. This second compression has the effect of eliminating the ovalization of the rolls, but also of eliminating for the most part the empty spaces 9 by giving the rolls a square cross section which is rounded at the corners (cf. FIG. 6).

Figure 7:
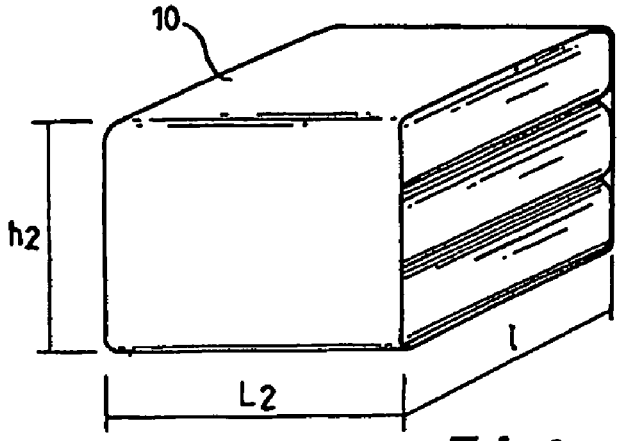
FIG. 7 shows a perspective view of a finished bundle of rolls according to the invention.

As shown in FIG. 7, a sleeve 10 covers the wrapped and superposed rows of rolls in the compressed state which is thus obtained. This sleeve covers the end surfaces 4 and 5 of the rolls, by extending preferably over the entirety of these surfaces. This sleeve, which is advantageously made of a non-extensible plastics material such as high density polyethylene, keeps the rolls in their state of compression which is obtained after the second compression. In the illustrated example of embodiment, the bundle according to the invention shown in FIG. 7 has a width l of 1200 mm, a length L2 of 1330 mm and a height h2 of 1200 mm. The obtained volume of the bundle is standard even if the diameter of the rolls used, and therefore the length of strip in each roll, is variable. Moreover, the bundle according to the invention once again has a density which is equivalent to that obtained after winding of the rolls. The loss of density usually does not exceed 5%, and it may even be equal to or greater than that obtained after winding of the rolls.

Advantageously, the width of the strip 1 may be variable without requiring any modification of the method according to the invention, since the sleeve is applied over the length of the rolls.

Figure 5:
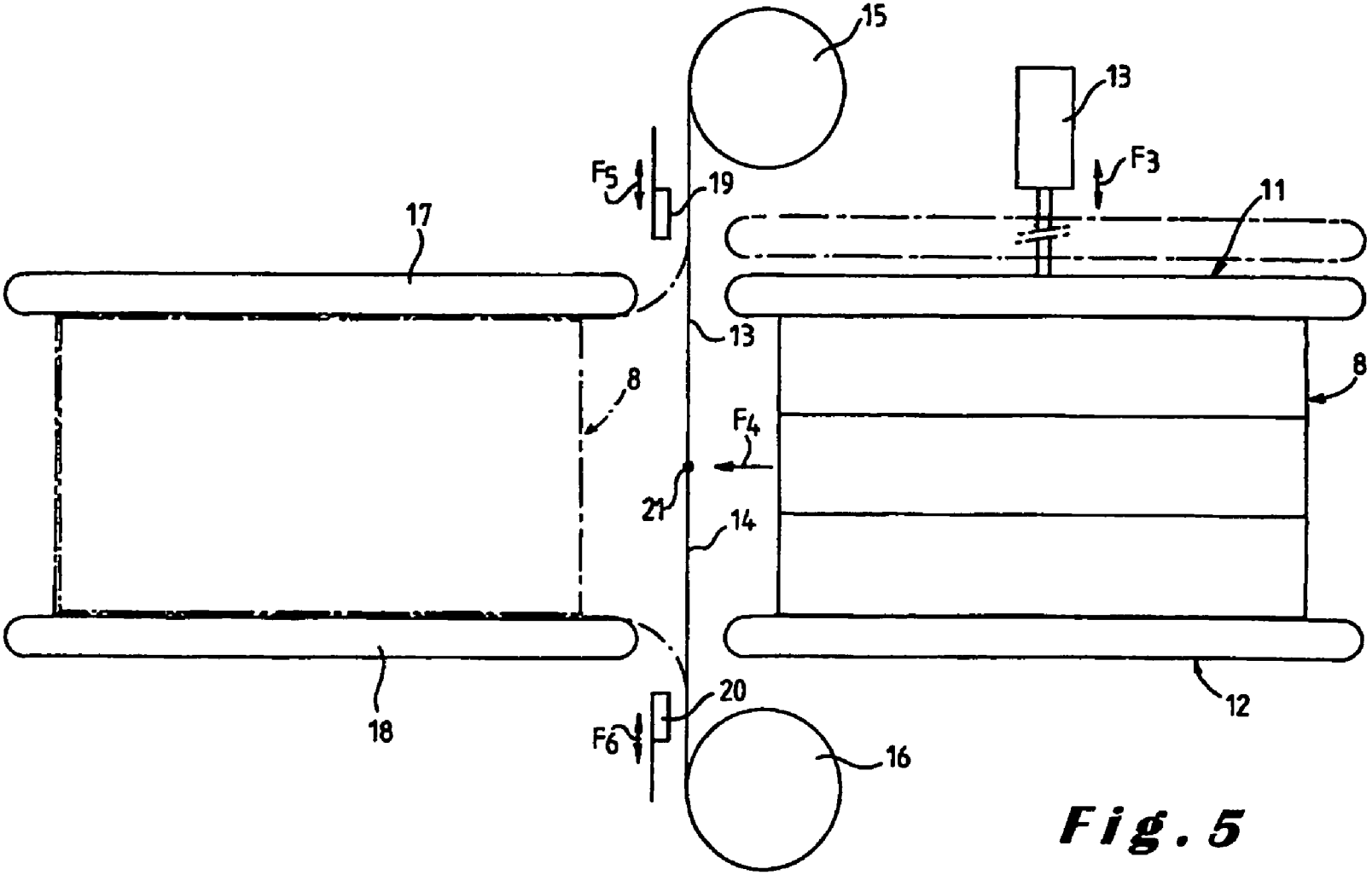
FIG. 5 shows a schematic side view of the compression and wrapping with a sleeve of the stack of rows of rolls.

In order to produce a bundle according to the invention as shown in FIG. 5 from a known bundle as shown in FIG. 4, use may be made of various suitable means which are known per se to the average person skilled in the art.

By way of example, an apparatus which can be used for this purpose is shown schematically in FIG. 5. The bundle of rolls shown in FIG. 4 is introduced between two conveyors 11 and 12. The conveyor 11 is formed of a belt rotating about a chassis which can be displaced upward and downward in the direction of the double arrow F3 by means of a control element 13 of the type consisting of a motor/rack, a hydraulic or pneumatic ram, etc. The bundle is introduced while the conveyor 11 is in the high position shown in broken line. The axes 2 of the rolls are arranged parallel to the direction of advance shown by the arrow F4. Once the bundle is located entirely between the two conveyors 11 and 12, the upper conveyor 11 is displaced downward so as to compress the bundle until the latter obtains the desired height value of the bundle.

In the illustrated example of embodiment, two strips of packaging material 13 and 14 which are sealed end to end at 21 extend in front of the outlet of the conveyors 11 and 12. The end surfaces (which are still uncovered) at one side of the rolls are pressed against these strips 13 and 14 and entrain them from reels 15 and 16 in the direction of advance F4. During this time, the bundle advances between two new conveyors 17 and 18, which are the same distance apart as the conveyors 11 and 12 when the conveyor 11 is in the low position. The bundle 8 is then passed entirely between the two conveyors 17 and 18 as shown in broken line. At this point, clamps 19 and 20, which can be moved back and forth in a direction shown by the double arrows F5 and F6, grip the strips 13 and 14 one against the other. In the illustrated example of embodiment, these clamps in the clamped position make it possible to form two horizontal seals, which are close to one another and parallel to one another, so as to close the sleeve, while at the same time sealing the two strips 13 and 14 end to end for the following bundle. These clamps also have, between the two sealing elements, a means which makes it possible to cut the elastic material between the two seals and to detach the bundle, for example an electrically heated wire or a knife which is displaced in the transverse direction. The sleeve thus maintains the effects of the second compression even when it exits from the conveyors 17 and 18.

The person skilled in the art will understand that other suitable means allow this compression and this wrapping to be carried out. For example, it would be possible to provide just one reel and one strip. Other methods of sealing the strips 13 and 14 could be envisaged. The direction of advance of the bundles could be oblique or even vertical.

It would also be possible to envisage the advance of the strip with respect to the bundle, so as to obtain the wrapping as shown in FIG. 7.

Figure 8:
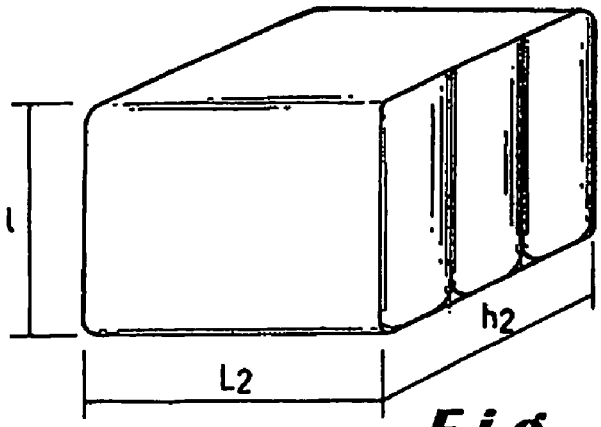
FIGS. 8 to 10 show a perspective view of the steps of setting upright the bundles according to the invention, stacking them and covering the stacked bundles.

The bundle according to the invention is then, in a manner known per se, set upright so that the axes 2 of the rolls are arranged vertically. As can be seen in FIG. 8, neither the bottom end surfaces of the rolls nor the top end surfaces are now in direct contact with the ground or with the surrounding environment, and this represents a marked improvement in terms of protecting the rolls against dirt and moisture.

Figure 9:
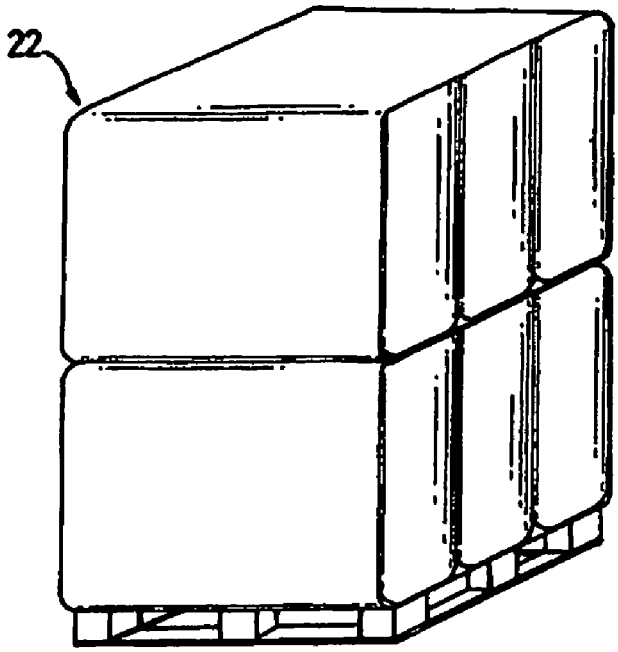
Figure 10:
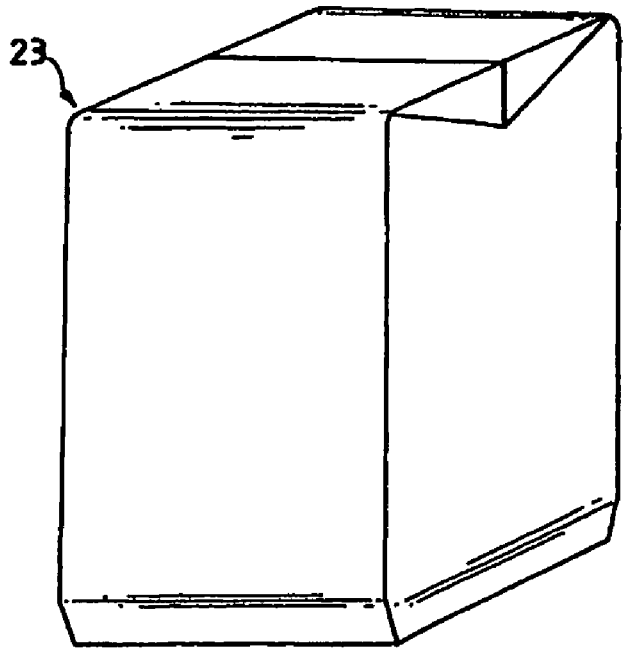

FIG. 9 shows the stacking, known per se, of two bundles 8. The stack 22 thus formed is highly resistant and protected on all its faces against weather conditions and dirt. Finally, a cover 23 may also be provided which covers the whole stack, as shown in FIG. 10.

Tests were carried out using various rolls.

In the examples 1 to 8 according to the invention, the rolls are arranged in rows, each row being compressed, wrapped and then stacked, and the stacked rows undergo an additional compression and an operation of wrapping in a sleeve, as described above.

The results of the tests are shown in the table below.

| | Strip | | | Roll | | | Bundle | | | | | |
|---|---|---|---|---|---|---|---|---|---|---|---|---|
| Ex | Thickness | Length | Width | Diameter | Density before winding | Density after winding | Rolls per row | Rows per bundle | Length | Height | Width | Density |
| 1 | 200 | 5000 | 1200 | 424 | 11.5 | 81.34 | 4 | 3 | 1330 | 1200 | 1200 | 86.47 |
| 2 | 200 | 6500 | 1200 | 484 | 11.5 | 81.34 | 3 | 3 | 1330 | 1200 | 1200 | 84.30 |
| 3 | 180 | 4500 | 1200 | 472 | 21 | 97.22 | 3 | 3 | 1330 | 1200 | 1200 | 95.92 |
| 4 | 180 | 3500 | 1200 | 416 | 21 | 97.22 | 4 | 3 | 1330 | 1200 | 1200 | 99.47 |
| 5 | 140 | 5500 | 1200 | 467 | 15 | 67.51 | 3 | 3 | 1330 | 1200 | 1200 | 65.13 |
| 6 | 140 | 4250 | 1200 | 410 | 15 | 67.51 | 4 | 3 | 1330 | 1200 | 1200 | 67.11 |
| 7 | 100 | 12500 | 1200 | 474 | 10.5 | 74.27 | 3 | 3 | 1330 | 1200 | 1200 | 74.01 |
| 8 | 100 | 9500 | 1200 | 414 | 10.5 | 74.27 | 4 | 3 | 1330 | 1200 | 1200 | 75.00 |

This table shows, on the one hand, the extremely high flexibility in terms of the length of strip to be wound for the bundles according to the invention and, on the other hand, the absence of any loss of density, while the dimensions of the bundle remain perfectly standard.

It must be understood that the present invention is in no way limited to the embodiments given above and that many modifications may be made thereto without departing from the scope of the appended claims.

The invention claimed is:

1. A bundle of rolls formed of an insulation strip made of a fibrous product having an initial density, said bundle comprising several aforementioned rolls, each having an axis, a peripheral surface and first and second ends, and being arranged one next to the other with their axes parallel, in a number of superposed rows, a packaging film which covers at least said peripheral surface of each roll of the insulation strip which, when wound up on itself, has a density which is greater than said initial density, and a wrapping film which wraps each row of several rolls, in a compressed state of the rolls against one another in a first direction perpendicular to the axes of the rolls, and which covers at least part of the peripheral surface of the rolls of the row, characterized in that said bundle furthermore comprises a sleeve which encloses the wrapped and superposed rows of rolls, in a compressed state of the rows against one another in a second direction perpendicular to the axes of the rolls and perpendicular to said first direction, and which covers the first and second ends of the rolls of the bundle and at least part of the peripheral surface of the rolls of a top row and of a bottom row of said superposed rows of the bundle, the bundle thus formed having a final density which is at least equal to 90%, preferably 95%, of said density which is greater than the initial density.

2. The bundle as claimed in claim 1, characterized in that the final density of the bundle is greater than or equal to said density which is greater than the initial density.

3. The bundle as claimed in claim 1, characterized in that, in the bundle, the rolls have a square cross section which is rounded at the corners.

4. The bundle as claimed in claim 1, characterized in that the wrapping film extends, on said at least part of the peripheral surface of the rolls which it covers, from the first end of the rolls to the second end.

5. The bundle as claimed in claim 1, characterized in that the sleeve extends over all of the first and second ends of all of the rolls of the bundle.

6. The bundle as claimed in claim 1, characterized in that the packaging film, the wrapping film and/or the sleeve are made of a non-extensible plastics material.

7. A stack of at least two bundles of rolls as claimed in claim 1.

8. The stack as claimed in claim 7, in which the rolls of each bundle are arranged with their axes in the vertical position and the stack has a bottom surface and a top surface which are covered by an aforementioned sleeve.

9. The stack as claimed in claim 7, characterized in that it comprises a cover which surrounds said at least two stacked bundles.

10. A method for producing a bundle of rolls as claimed in claim 1, comprising a winding-up of an insulation strip made of a fibrous product, having an initial density, so as to form rolls having then a density which is greater than said initial density, a first wrapping of each roll with a packaging film which covers at least their aforementioned peripheral surface, the arrangement of several aforementioned rolls one next to the other with their axes parallel to form rows, a first compression one against the other of the rolls of each row in a first direction perpendicular to the axes of the rolls, a second wrapping with a wrapping film of each row of several rolls, in a compressed state resulting from the first compression, so as to cover at least part of the peripheral surface of the rolls of the row, a superposition of several rows of rolls thus wrapped, and a second compression one against the other of wrapped and superposed rows of rolls in a second direction perpendicular to the axes of the rolls and perpendicular to said first direction, characterized in that said method furthermore comprises a third wrapping with a sleeve of the wrapped and superposed rows of rolls, in a compressed state resulting from the second compression, so as to cover the two ends of the rolls of the bundle and at least part of the peripheral surface of the rolls of a top row and of a bottom row of said superposed rows of the bundle, the bundle thus formed having a final density which is at least equal to 90%, preferably 95%, of said density which is greater than the initial density.

11. The production method as claimed in claim 10, characterized in that the third wrapping comprises advancing the wrapped and superposed rows of rolls in a direction of advance which is parallel to the axes of the rolls.

12. The method as claimed in claim 11, characterized in that during this advance, a pressing of one of the ends of the rolls of the superposed rows against two strips of packaging material which are sealed end to end, and a covering with these strips of said one of the ends of the rolls and then of at least part of the peripheral surfaces of the rolls of said top and bottom rows, a joining of the two strips by applying them along the other of the ends of the rolls of the superposed rows, with the strips being sealed together, and a cutting of the sealed strips so as thus to form, on the one hand, a sleeve which covers the superposed rows of rolls and, on the other hand, once again two strips of packaging material which are sealed end to end.

13. The method as claimed in claim 10, characterized in that the third wrapping comprises advancing a strip of packaging material around the bundle of rolls, in a direction of advance which is parallel to the axes of the rolls, so as to form said sleeve.

14. The method as claimed in claim 11, characterized in that the aforementioned direction of advance is horizontal and in that the method furthermore comprises, after said third wrapping, setting the bundle upright so that the axes of the rolls are arranged vertically, and so that each bundle has a bottom surface and a top surface which are covered by the aforementioned sleeve.

15. The method as claimed in claim 14, characterized in that it furthermore comprises a stacking of at least two bundles of rolls so as to form a stack having a bottom surface and a top surface which are covered by an aforementioned sleeve.

16. The method as claimed in claim 15, characterized in that it furthermore comprises a covering of the stack of bundles of rolls.

17. The method as claimed in claim 11, characterized in that, during the second compression, the rolls acquire a square cross section which is rounded at the corners.

* * * * *